United States Patent [19]

Deutsch et al.

[11] 4,191,081

[45] Mar. 4, 1980

[54] SELECTABLE AUTOMATIC ARPEGGIO FOR ELECTRONIC MUSICAL INSTRUMENT

[75] Inventors: Ralph Deutsch; Leslie J. Deutsch, both of Sherman Oaks, Calif.

[73] Assignee: Kawai Musical Instrument Mfg. Co., Ltd., Hamamatsu, Japan

[21] Appl. No.: 904,733

[22] Filed: May 11, 1978

[51] Int. Cl.[2] ..... G10H 1/00; G10H 5/00

[52] U.S. Cl. ..... 84/1.03; 84/1.24; 84/DIG. 22

[58] Field of Search ..... 84/1.01, 1.03, 1.24, 84/DIG. 12, DIG. 22

[56] References Cited

U.S. PATENT DOCUMENTS

| | | | |
|---|---|---|---|
| 3,718,748 | 2/1973 | Bunger | 84/1.24 |
| 3,725,562 | 4/1973 | Munch, Jr. et al. | 84/1.24 |
| 3,842,182 | 10/1974 | Bunger | 84/1.03 |
| 3,842,184 | 10/1974 | Kniepkamp et al. | 84/1.01 |
| 3,854,366 | 12/1974 | Deutsch | 84/1.24 |
| 4,019,417 | 4/1977 | Carlson | 84/1.01 |
| 4,054,078 | 10/1977 | Kondo | 84/1.24 |
| 4,080,862 | 3/1978 | Hiyoshi et al. | 84/1.24 |
| 4,106,385 | 8/1978 | Roberts | 84/1.24 |
| 4,154,131 | 5/1979 | Studer et al. | 84/1.03 |

*Primary Examiner*—S. J. Witkowski

*Attorney, Agent, or Firm*—Christie, Parker & Hale

[57] ABSTRACT

An automatic arpeggio for a keyboard-operated instrument in which a tone generator is assigned to a key when the key is actuated, the fundamental frequency of the assigned tone generator being determined by octave and note data stored as a control word in a memory in response to operation of the key. On keying the different notes of the arpeggio chord on the keyboard and activating an arpeggio Load switch, a control word is loaded in the memory for each key of the arpeggio chord, the words being coded to identify the value of the note and the sequence number of the note in the arpeggio chord. The arpeggio chord control words in memory are transferred one at a time to a tone generator in a sequence according to the stored sequence numbers of the control words. Arithmetic means, in synchronism with an arpeggio clock, generates note sequence numbers by which the control words are addressed in memory. The note value is transferred to the tone generator together with octave information from the arithmetic means. The tone generator, in response to the octave and note information received with each control word, generates the corresponding tone. The arithmetic unit changes the note sequence number for addressing a different control word of the arpeggio chord with each arpeggio clock. The arithmetic unit is capable of modifying the note number and the octave number in various types of sequences under the selective control of the musician.

15 Claims, 5 Drawing Figures

MASTER CLOCK
56
NOTE COUNTER MODULO 12
64
0-11
CLOCK COUNTER MODULO 12
66
65
61
62
31a
31l
ASSIGNMENT LOGIC
504
GROUP COUNTER MODULO 6
57
503
R
36-41 GROUP 1-6
86
DIVISION COUNTER MODULO 4
42-44 DIV 1-3
DIV 4
63
501
SAME
COMPARATOR
68
42-44
87
506
DIV
GROUP
NOTE
NOTE NO.
82
ASSIGNMENT MEMORY
SET
86'
87'
83
0
1
514
MEMORY ADDRESS/ DATA WRITE
516
MAX
COUNT UP
ARPEGGIO COUNTER N=1→4
N
510
DIV.4
OS
511
R
512
01
1
F
F
509
501
LOAD
OS
507
508
(SEE FIG. 1)

ARPEGGIO CLOCK
RESET
COUNTER MODULO 4
572
HI
COMPARATOR
570
566
568
SN=1
INPUT
UP
DOWN
OCTAVE
ARPEGGIO NOTE NO.
N
564
OCTAVE INCREMENTER
CARRY
DOWN
UP
562
N
OCTAVE
ARPEGGIO NOTE NO.
OUTPUT

SELECTABLE AUTOMATIC ARPEGGIO FOR ELECTRONIC MUSICAL INSTRUMENT

FIELD OF THE INVENTION

This invention relates to electronic musical instruments, and more particularly, is concerned with an automatic arpeggio control for a digital polyphonic tone synthesizer.

BACKGROUND OF THE INVENTION

Various types of automatic arpeggio controls for keyboard electronic musical instruments have been heretofore proposed. The automatic arpeggio plays the notes of a chord in an up or down sequence, repeating the sequence in successively higher or lower octaves of the instrument. The notes of the arpeggio chord can progress either upwardly from the lowest note of the lowest octave to the highest note of the highest octave, or progress down from the highest note of the highest octave to the lowest note of the lowest octave. The arpeggios can be made continuous and the time interval between arpeggio notes can be controlled to control the rhythm. Most known automatic arpeggio systems are designed for beginners or relatively unskilled musicians. A standard chord is selected by pushing a corresponding one of a plurality of buttons, rather than allowing the musician to key the individual notes of the chord in conventional manner. The arpeggio control is usually completely separate from the standard keyboard of the instrument.

A selectable note arpeggio system is described in U.S. Pat. No. 3,854,366. The arpeggio system therein described requires a completely separate control circuit for detecting and assigning the notes used for the arpeggio chord from that used by the instrument for generating tones in the standard manner in response to the playing of the keyboard.

SUMMARY OF THE INVENTION

The present invention is directed to an improved automatic arpeggio which permits the keyboard of the instrument to be used to select and store the note information on the arpeggio chord without interfering with the normal playing mode of the instrument. In other words, the musician can play a chord in conventional manner on the instrument and simultaneously can use the same chord to load and start the automatic arpeggio. The same note detect and assignment circuitry used to detect and assign tone generators to keys as they are depressed is also used to store and control the subsequent sounding of the arpeggio tones. Once the arpeggio chord information is loaded in response to playing of the notes in the chord, the automatic arpeggio using those chord notes can be initiated at any time by the musician. The sequencing pattern using the notes of the arpeggio chord as well as the timing can be modified in a variety of ways by the musician to produce various harp-type arpeggio patterns.

These and other advantages of the present invention are achieved by using an automatic arpeggio control which is incorporated as part of the key switch detect and assignor circuit described in U.S. Pat. No. 4,022,098. The same keyboard of the instrument is time shared between two divisions, the standard keyboard division and an added automatic arpeggio division. At any time while playing the instrument, an arpeggio load switch may be actuated to load the same notes sounded by the currently depressed keys on the standard division keyboard as the arpeggio chord notes. The key switch detect and assignor circuit stores the note information during the normal division scan of the keyboard and assigns the notes to a plurality of tone generators in conventional manner, but also separately stores the note information, the number of notes in the chord, and stores the sequence number of the relative positions of each note in the arpeggio chord in response to operation of the load switch. The musician at any time after the chord information is loaded can initiate an automatic arpeggio. An arithmetic control unit, in synchronism with an arpeggio clock, transfers the stored arpeggio chord note information in a controlled sequence to an arpeggio tone generator together with octave information. Using the current chord position number and octave number of an arpeggio note, the arithmetic unit calculates the note number and octave for the next arpeggio note in sequence to be applied to the arpeggio tone generator, so that notes of the arpeggio chord are sounded automatically in sequence through each of the octaves of the keyboard. The arithmetic unit, in response to a number of input parameters, such as the number of notes in the arpeggio chord, arpeggio up or down signals, and inputs indicating the number of arpeggio notes to be played in successive overlapping sequences and the number of notes repeated in each successive sequence, calculates the octave and note number of the next note to be sounded by the tone generator.

DESCRIPTION OF THE DRAWINGS

For a better understanding of the invention reference should be made to the accompanying drawings, wherein.

DETAILED DESCRIPTION

In U.S. Pat. No. 4,085,644, entitled "Polyphonic Tone Synthesizer," there is described a musical tone generating system in which any one of a plurality of tone generators is assigned to a note when a key is actuated. As each key is actuated on the instrument, data identifying the note and the key assignment status is stored in an assignment memory. A circuit for sensing the condition of the keys and storing such information is described in U.S. Pat. No. 4,022,098 entitled "Keyboard Switch Detect and Assignor." Once a key is assigned to a note generator, the pitch of the note is determined by a voltage controlled oscillator in the assigned tone generator in response to the note information stored when the key is actuated. The manner of controlling the frequency of the oscillator for each tone generator is described in detail in U.S. Pat. No. 4,067,254. The present invention, while not specifically limited to an instrument incorporating the features of the above-identified patents, is described herein in the preferred embodiment as a modification to such system. These patents and patent applications are hereby incorporated by reference.

Figure 1:
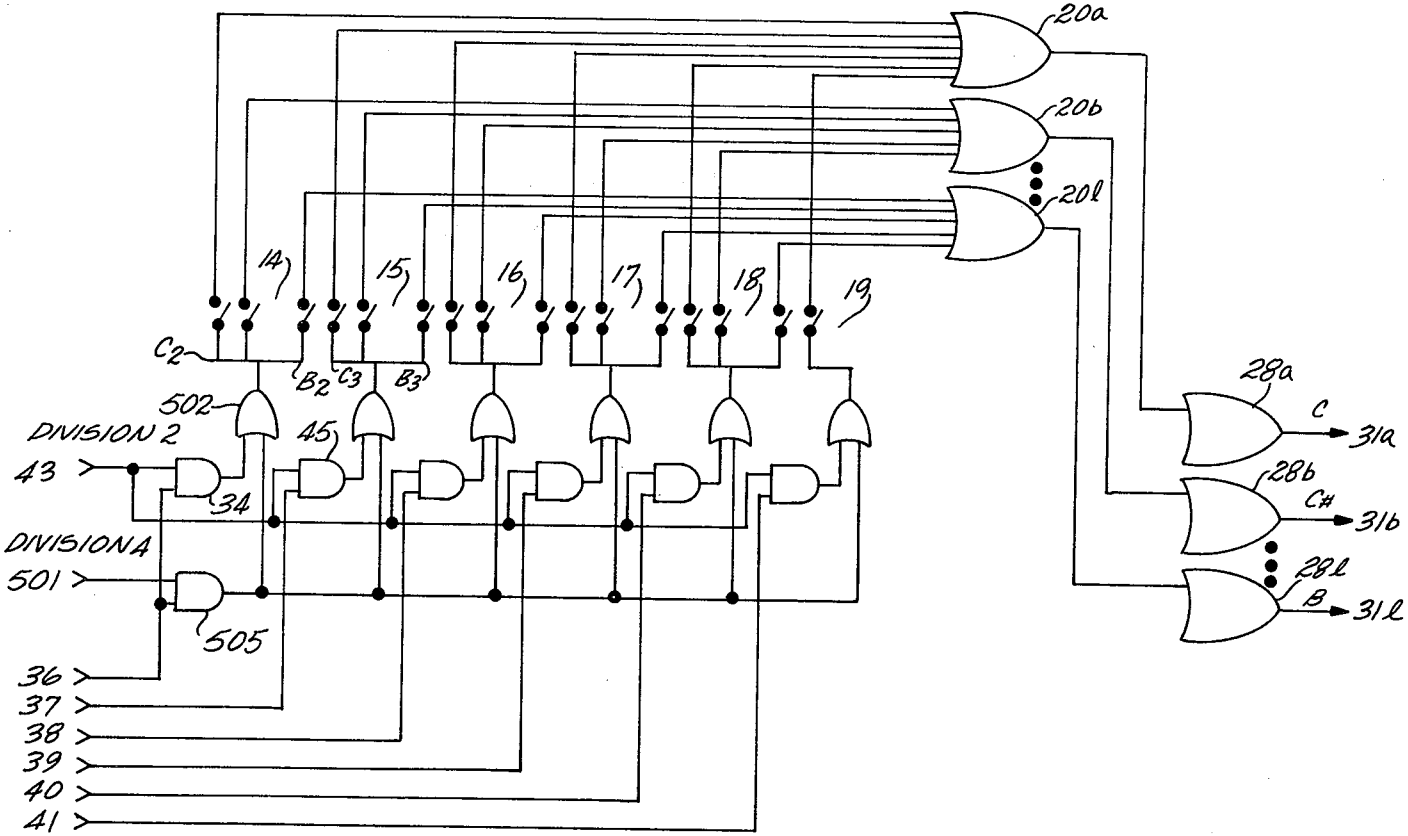
FIG. 1 is a schematic circuit diagram of the keyboard switch detect circuit.

The automatic arpeggio of the present invention is preferably incorporated as a feature of one keyboard manual or division, for example, Division 2. Once the notes selected for an arpeggio chord are detected and stored by the keyboard switch detector and assignor circuit, the Division 2 keyboard can be used in normal manner as one manual of the instrument. The manner in which the keyboard switch detect and assignor circuit, described in detail in U.S. Pat. No. 4,022,098, is modified to incorporate the automatic arpeggio features of the present invention is described in detail in connection with FIGS. 1 and 2. The keyboard of Division 2, as described in the patent, consists of six octaves, each octave including the notes C through B of the chromatic scale. The keys associated with each octave in a division are scanned by a group counter 57 by six output lines 36–41. The Division 2 key detect logic is shown in FIG. 1 as modified to use the same key switches for setting the automatic arpeggio chord. The division counter 63 (see FIG. 2) is modified to scan four divisions, rather than the three divisions described in Pat. No. 4,022,098. Division 4 is used to scan the same keys as are scanned for Division 2. A line 501 from the division counter 63 is energized when the division counter is in the Division 4 state. The line 501 is applied to a logical AND circuit 505 together with the line 36 from the group counter 57. The output from the AND circuit 505 is applied to all six groups of key switches simultaneously. Operating a key corresponding to the same note in any of the six octaves produces a signal on the corresponding one of the twelve output lines 31*a*–31*l*. Thus when operating in the automatic arpeggio mode, operation of keys in any of the octaves of the Division 2 keyboard will product the corresponding audible notes from the instrument during the Division 2 scan in the normal manner, but will also produce note identifying output signals during the Division 4 operation which are used to generate the arpeggio chord. These notes, as hereinafter described in detail, are stored and assigned, one at a time, to an arpeggio tone generator, the keyed notes being played in sequence up and down the full six octave range of Division 2 of the instrument.

Figure 2:
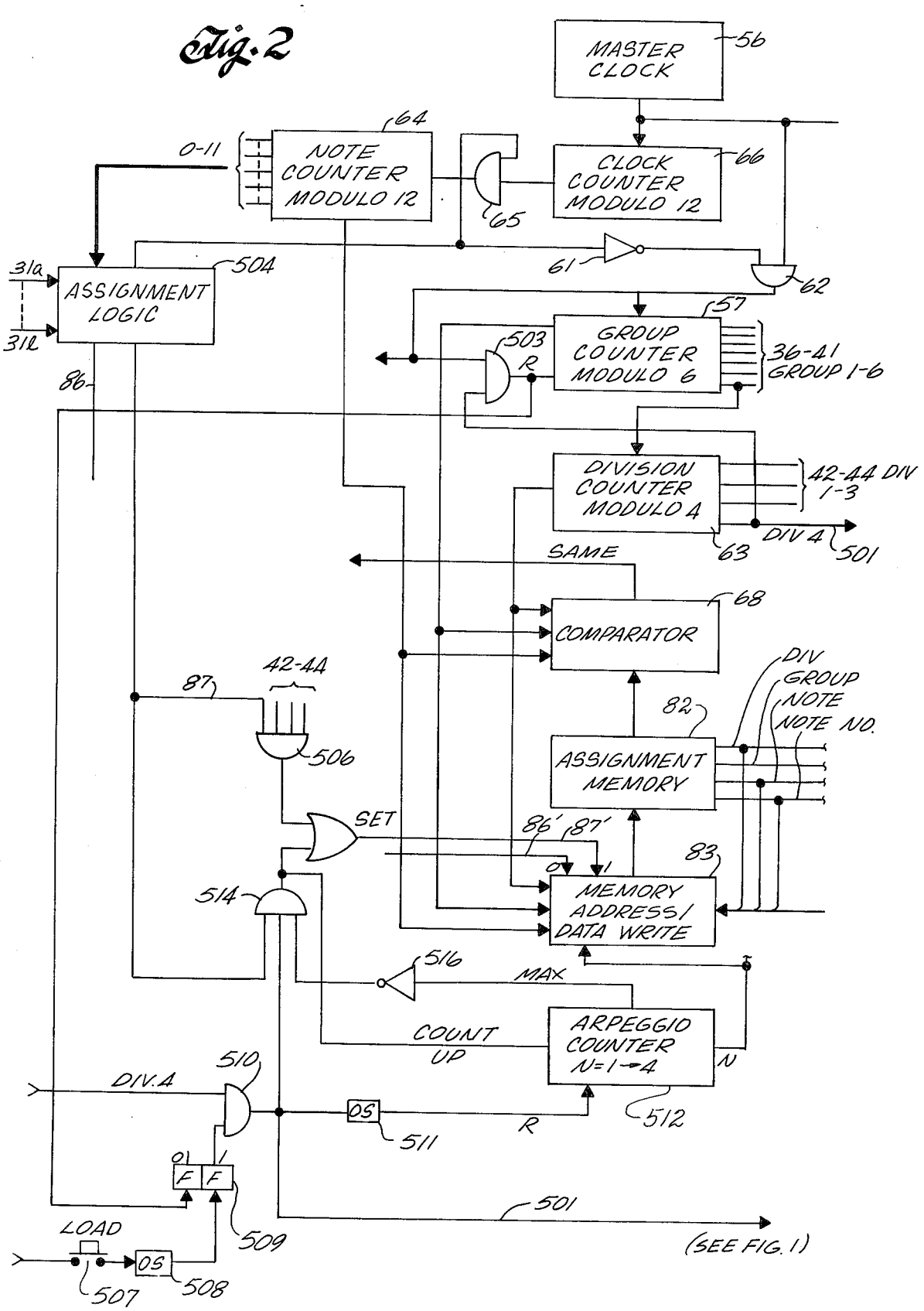
FIG. 2 is a schematic block diagram of the control circuit for loading the assignment memory with the note information identifying the actuated keys.

Referring to FIG. 2 in detail, the group counter 57 and division counter 63 of the keyboard switch detect and assignor circuit are counted in response to clock pulses from the master clock 56. Because the Division 4 state of the division counter 63 activates all six groups simultaneously, rather than scanning the groups in sequence, the group counter 57 does not need to scan through all six states before advancing the division counter 63 back to the Division 1 state again. An AND circuit 503 senses that the division counter is in the Division 4 state and in response to the next clock pulse resets the group counter 57, causing the division counter 63 to be advanced by the overflow from the group counter with the next pulse. Otherwise the group counter 57 and division counter 63 function to scan the octaves of the respective keyboard manuals of the instrument exactly as described in Patent No. 4,022,098.

As further described in detail in the above-identified Pat. No. 4,022,098, whenever a signal is received on one of the lines 31*a*–31*l* by the keyboard switch detect circuit, the assignment logic, indicated generally at 504 in FIG. 2, stores a bit in a register associated with the particular input line. Thus there is one register per each of the twelve notes C through B of one octave. Each register has one bit storage position for each of the octaves in the three divisions of the instrument. For the automatic arpeggio of the present invention, each register has an additional bit location for storing a bit indicating that during Division 4 operation the corresponding note in any one of the octaves has been actuated on the keyboard by the musician. Whenever the assignment logic 504 determines that a new key has been depressed during a scan cycle, the keyboard scanning by the group counter 57 and division counter 63 is halted temporarily and a note counter 64 is counted. In response to the sequential output of the note counter 64, the assignment logic 504 scans the input lines to determine which one has had the key switch closed or opened since the last scan. The logic then sets the bit for that octave and division in the associated register and generates an output pulse on the output line 87 which is applied to the memory address/data Write control circuit 83 to store the current status of the note counter 64, group counter 57, and division counter 63 in the assignement memory 82. When operating with the division counter pointing to either Divisions 1, 2, or 3, an AND circuit 506 connects the output signal from the assignment logic 504 directly to the input line 87′ to the memory address-/data Write control 83, exactly in the manner as described in the above-identified U.S. Pat. No. 4,022,098.

To operate the automatic arpeggio, the keyed notes are loaded in the assignment memory 82 for Division 4 in addition to the normal loading of the same notes for Division 2. The notes are loaded for Division 4 in response to the operation of a LOAD pushbutton switch 507 by the musician. When the switch 507 is closed with one or more keys depressed, it operates a one-shot multivibrator 508 which sets a flip-flop 509. An AND circuit 510 senses when the next Division 4 state is reached by the division counter 63. The output of the AND circuit 510 operates a one-shot multivibrator 511 to reset an arpeggio counter 512. The function of the arpeggio counter is to keep track of the number of notes being keyed into the automatic arpeggio. While the number of notes presumably could be any number up to twelve, the maximum number of notes in an octave, a maximum number of four notes is generally sufficient for the arpeggio chord and so the output counter 512 is a value $N=1, \ldots 4$.

The output of the AND circuit 510 provides a signal to the control line 501 to the switch detect circuit of FIG. 1 to indicate that the loading of the arpeggio notes has been initiated. The output of the AND circuit 510 is also applied to an AND circuit 514 together with the output line 87 from the assignment logic 504 and output from the arpeggio counter 512, indicating that the arpeggio counter is in its maximum count state, applied through an inverter 516. The output of the AND circuit 514 is used to count up the arpeggio counter 512 each time the memory address/data write control 83 is activated to store an arpeggio note in the assignment memory 82. The word written in the assignment memory 82, in addition to storing the current status of the note counter 64, group counter 57 (which is always pointing to the lowest octave), and division counter 63 (which is pointing to Division 4), also stores the current status of the arpeggio counter 512. Thus by actuating a group of keys on the Division 2 keyboard of the instrument and then actuating the LOAD switch 507, the musician causes a group of words corresponding to the number of keys actuated up to the maximum number permitted by the arpeggio counter 512 to be stored as Division 4 control words in the assignment memory 82. Each word includes bits identifying that the division counter was in the Division 4 state, that the group counter was pointing to the first group or first octave of the keyboard, that the note counter 64 was pointing to the specific note, i.e., the selected keyed notes C through B of the chromatic scale, and whether the note is the first, second, third, or fourth note of the arpeggio chord as determined by the arpeggio counter 512. Because the notes are scanned in sequence by the note counter 64, the lowest note in the scale will always be the first note in the arpeggio chord, with the higher notes in the scale having successively higher note numbers up to the maximum count permitted by the arpeggio counter 512. The loading function is complete when the note counter 64 and assignment logic 504 have scanned the input lines 31*a*–31*l* for the twelve possible notes. The assignment logic then interrupts the counting of the note counter 64 and causes the group and division counters to resume their scan. The output of the AND circuit 503 resets the flip-flop 509.

Figure 3:
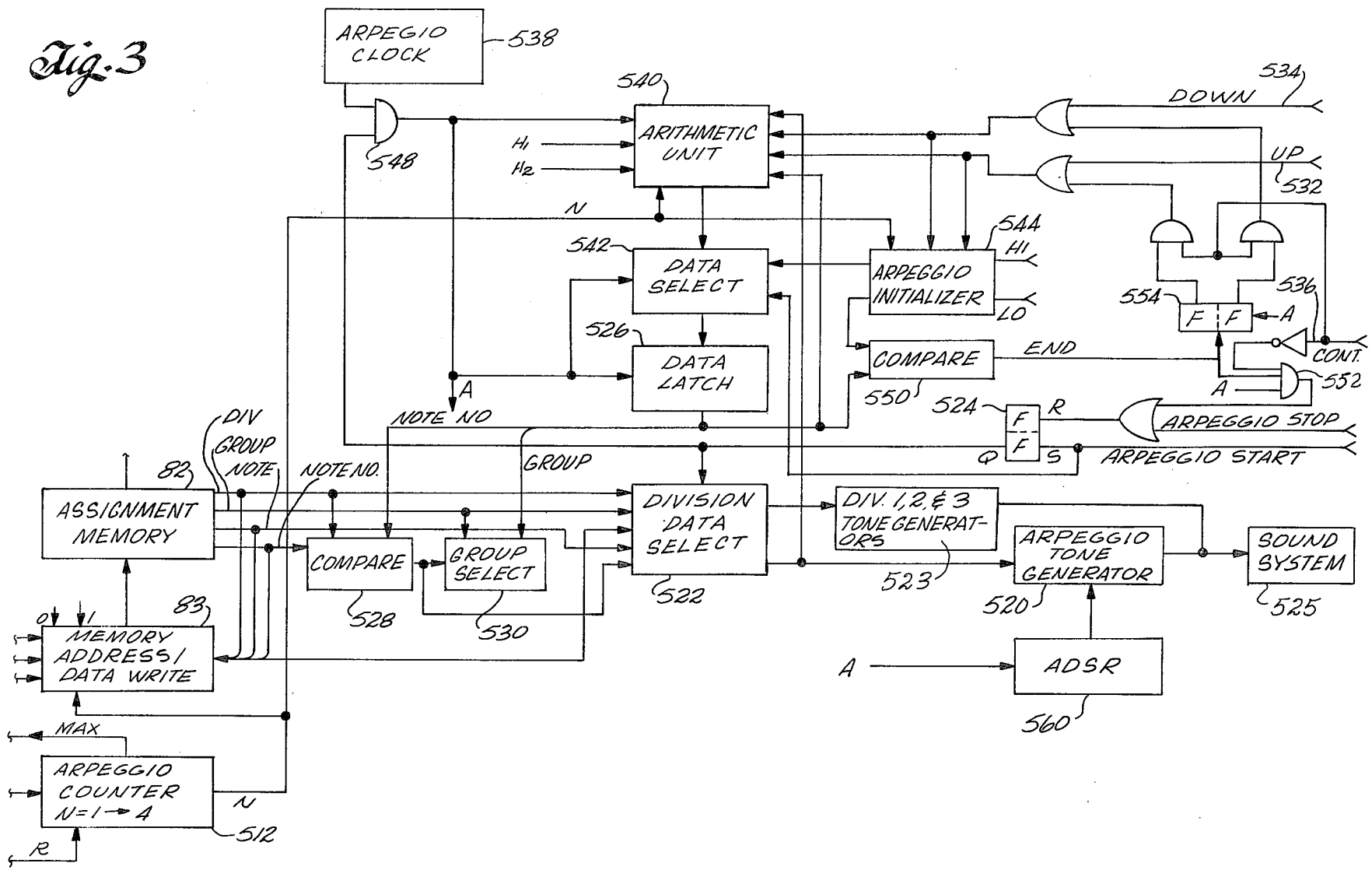
FIG. 3 is a schematic block diagram of the control circuit for assigning the stored arpeggio notes to the arpeggio tone generator.

Referring to FIG. 3, once the assignment memory 82 is loaded with words identifying the notes of the arpeggio scale, these words are read out of the assignment memory 82 in a controlled manner and applied sequentially to an arpeggio tone generator, indicated generally at 520, through a division select circuit 522 to generate the arpeggio chord notes in sequence running up, down, or continuously up and down the six octave range of the instrument. The arpeggio notes can also be sounded in a harp-type arpeggio in which a group of notes are played in overlapping sequence. During the time the notes are being sounded by the tone generator, all, the words stored in the assignment memory 82 in response to operation of keys on the keyboard are being read out of the memory continuously in a repetitive sequence until release of a key cancels the associated word in the assignment memory 82. For example, the assignment memory 82 may be operated as an end-around shift register which is shifted in synchronism with the clock pulses from the master clock 56. Alternatively it may be operated as an addressable memory in which the addresses are generated sequentially in synchronism with the pulses from the master clock 56. The division, group, and note information of each word as it is read out of the assignment memory 82 is applied to the division data select circuit which directs all Division 1, 2, and 3 words read out of the assignment memory 82 directly to tone generators 523. The Division 4 words are directed to the tone generator 520. The tone generators 520 and 523, in response to the respective digital words identifying the keyed notes of the scale, generate audio signals corresponding in frequency to the identified notes. The audio signals are applied to an audio sound system 525. The manner in which the digital words control the audio pitch generated by the respective tone generators is not material to the present invention. An example of one suitable tone generator is described in detail in U.S. Pat. No. 4,067,254 wherein each tone generator is in the form of a register storing data defining the amplitudes of equally spaced points along one cycle of the desired audio signal. The data is repeatedly read out of the register to a digital-to-analog converter at a clock rate proportional to the desired pitch of the musical note. The clock rate is controlled by a voltage-controlled oscillator. The frequency setting voltage in turn is set by decoding the octave and note information of the word read out of the assignment memory 82 and assigned to the particular tone generator.

The Division 4 words read out of the assignment memory 82 are used to generate the arpeggio chords in the following manner. When the musician wants to start the playing of the arpeggio chord after the assignment memory 82 has been loaded by actuating the load button 507 and keying the appropriate notes on the keyboard of Division 2, the musician operates a switch which applies an Arpeggio Start level for setting a control flip-flop 524. The output of the flip-flop 524 is applied to the division data select circuit 522 to indicate that arpeggio notes can now be generated by a transferring of Division 4 control words from the assignment memory 82 to a tone generator 520 dedicated to generating the arpeggio notes. Since the arpeggio tone generator 520 generates only one note at a time of the arpeggio chord, the division data select circuit 522 selects only one of the Division 4 words at a time for application to the tone generator 520. The selection of the word to be applied to the arpeggio tone generator 520 during the playing of the automatic arpeggio is determined by the contents of a data latch 526. The data latch, controlled in a manner hereinafter described, stores a single control word which identifies the octave or group number of the arpeggio tone being generated and the note number within the arpeggio chord of the note being generated.

Assuming that the automatic arpeggio has just been started and a musician has set the instrument to play an arpeggio in which the arpeggio notes are sounded going up the scale, the data latch 526 is initialized, in a manner hereinafter described, to store the lowest note number and the lowest group number. As the words are read out of the assignment memory 82, a compare circuit 528 compares the note number of each Division 4 word with the note number stored in the data latch 526. If the note numbers are the same, the output of the compare circuit causes the corresponding word to be transferred by the division data select circuit 522 to the arpeggio tone generator 520. At the same time the memory address/data write control 83 writes the word back into the same word location in the assignment memory 82 without modification.

The note numbers in the latch are changed periodically in a manner to select the other notes in the arpeggio. The group number is then changed to repeat the notes in the successively higher octaves. The group number in the control word of each arpeggio note must be changed after it has been played in one octave so that it can be subsequently sounded in the next higher octave in generating an "UP" arpeggio. When the group number in the data latch 526 is increased, the group number in the word selected by the compare circuit 528 must be modified before the word is selected for the tone generator 520. Assuming each of the notes of the arpeggio chord has been sounded in the lowest octave, the octave number in the data latch 526 is incremented so that the same notes can be sounded in the next highest octave. The group select circuit 530 compares the group information of the word read out of the assignment memory 82 with the group information stored in the data latch 526. If they are different, the group select circuit 530 causes the group number in the data latch 526 to be passed to the division data select circuit 522 and be written into the word in the assignment memory 82 in place of the previous group information of the control word. In operation, the note number and group number stored in the data latch at any given time is used to select a word read out of the assignment memory 82 which is associated with Division 4 and transfers the word to the arpeggio tone generator 520. The word remains unchanged until the group number in the data latch 526 is changed to the next higher octave, at which time the group number in the control word is updated. In this manner, the control word associated with a particular note in the arpeggio chord can produce the same notes in each octave in succession.

The information as to the note number and group number stored in the data latch 526 is controlled by an arithmetic unit 540 in the following manner. The musician can select several modes of arpeggio operation. By suitable manual control he can provide an input level on either an UP input line 532, a DOWN input line 534, or a CONTINUOUS input line 536. The musician can also set the repetition frequency of an arpeggio clock 538 which controls the timing interval at which successive notes of the arpeggio chord are initiated. Thus the arpeggio clock 538 determines whether the arpeggio is played slowly or rapidly. The UP and DOWN signals are applied to the arithmetic unit 540 together with the output of the arpeggio clock 538. In addition, the musician has the choice of providing a standard arpeggio in which the notes of the arpeggio chord are sounded in progression, or providing a harp-like arpeggio in which the notes are sounded in an overlapping progression. These effects are controlled by the arithmetic unit 540 in response to two additional input values controlled by the musician, indicated as $H_1$ and $H_2$. $H_1$ may be set to any value $1 \rightarrow 4$ for example. For $H_1=1$, the standard arpeggio mode is generated. For any other value $H_1$, the number $H_1$ of arpeggio notes is played in sequence. The sequence is then repeated after dropping back $H_2$ notes in the sequence. For example, if $H_1=4$ and $H_2=2$, with the arpeggio chord consisting of notes C, E, and G of the scale, the UP arpeggio would be played in the following sequence:

$$C_1E_1G_1C_2/E_1G_1C_2E_2/G_1C_2E_2G_2/C_2 \ldots$$

The arithmetic unit 540, in a manner hereinafter described in detail in connection with FIGS. 3 and 4, controls the group and note number information stored in the data latch 526 in synchronism with the arpeggio clock 538 to achieve the desired automatic sequencing of the arpeggio chord.

When the arpeggio start signal sets the flip-flop 524 it causes a data select circuit 542 to transfer the output of an arpeggio initializer circuit 544 to the data latch 526. The arpeggio initializer senses whether the UP arpeggio or the DOWN arpeggio signal is activated. If the UP arpeggio signal is activated, the arpeggio initializer sets the lowest group number and the lowest note number in the data latch 526. Thus the data latch points to the lowest note of the lowest octave at the start of the arpeggio run. If the DOWN arpeggio signal is received by the arpeggio initializer 544, it sets the number of the highest note in the arpeggio chord, as determined by the count condition N of the arpeggio counter 512 in the data latch along with the group number of the highest octave. The initial high and low group numbers for the arpeggio may be manually set by the input liner Hi and Lo into the arpeggio initializer circuit by the musician, allowing the limits of arpeggio run to extend over any selected number of octaves.

The data select 542 in response to the arpeggio Start signal applies the output of the arpeggio initializer to the data latch and the latch is set in response to the next clock pulse from the arpeggio clock 538. The arpeggio clocks are derived through an AND circuit 548 which is controlled by the output of the flip-flop 524 so that arpeggio clocks are provided to the latch 526 and arithmetic unit 540 whenever the flip-flop 524 has been set by an arpeggio start signal. At the same time, the data select 542 is reset so that subsequent inputs to the data latch are derived from the arithmetic unit 540. With each subsequent arpeggio clock 538, the arithmetic unit updates the data in the latch 526. In this manner, the latch points to each subsequent note to be played in the arpeggio chord with each new clock pulse from the arpeggio clock 538.

With the last note in the UP sequence or the DOWN sequence of the arpeggio, a compare circuit 550, by comparing the contents of the last note in the arpeggio run as derived from the arpeggio initializer 544 with the contents of the data latch 526, signals that the last note is being addressed by the data latch 526. The output of the compare circuit 550 is applied as one input to an AND circuit 552, which also senses that the Continuous state on the line 536 is off and senses the next arpeggio clock source 538. The output of the AND circuit 552 resets the control flip-flop 524, terminating the automatic arpeggio operation. The flip-flop 524 can also be reset by an arpeggio Stop signal initiated by the musician. If a continuous arpeggio operation is desired, the output of the compare circuit 550 triggers a bi-stable flip-flop 554 to its opposite state in response to the next arpeggio clock. The bi-stable flip-flop 554 alternately applies the control signal on the continuous line 536 to either the UP or DOWN signals going to the arithmetic unit and to the arpeggio initializer. In this manner, when the Continuous mode is operating, an UP arpeggio, when completed, is immediately followed by a DOWN arpeggio, and visa-versa. Thus the arpeggio continues to cycle automatically UP and DOWN until an arpeggio Stop signal resets the control flip-flop 524.

The arpeggio clock at the output of the AND circuit 548 is also used to trigger the attack phase of an ADSR generator 560 which controls the envelope waveshape of the output of the arpeggio tone generator 520. The ADSR generator 560 controls the attack, decay, sustain and release characteristics of the arpeggio tones and may be of a type, for example, such as described in U.S. Pat. No. 3,610,805.

Figure 4:
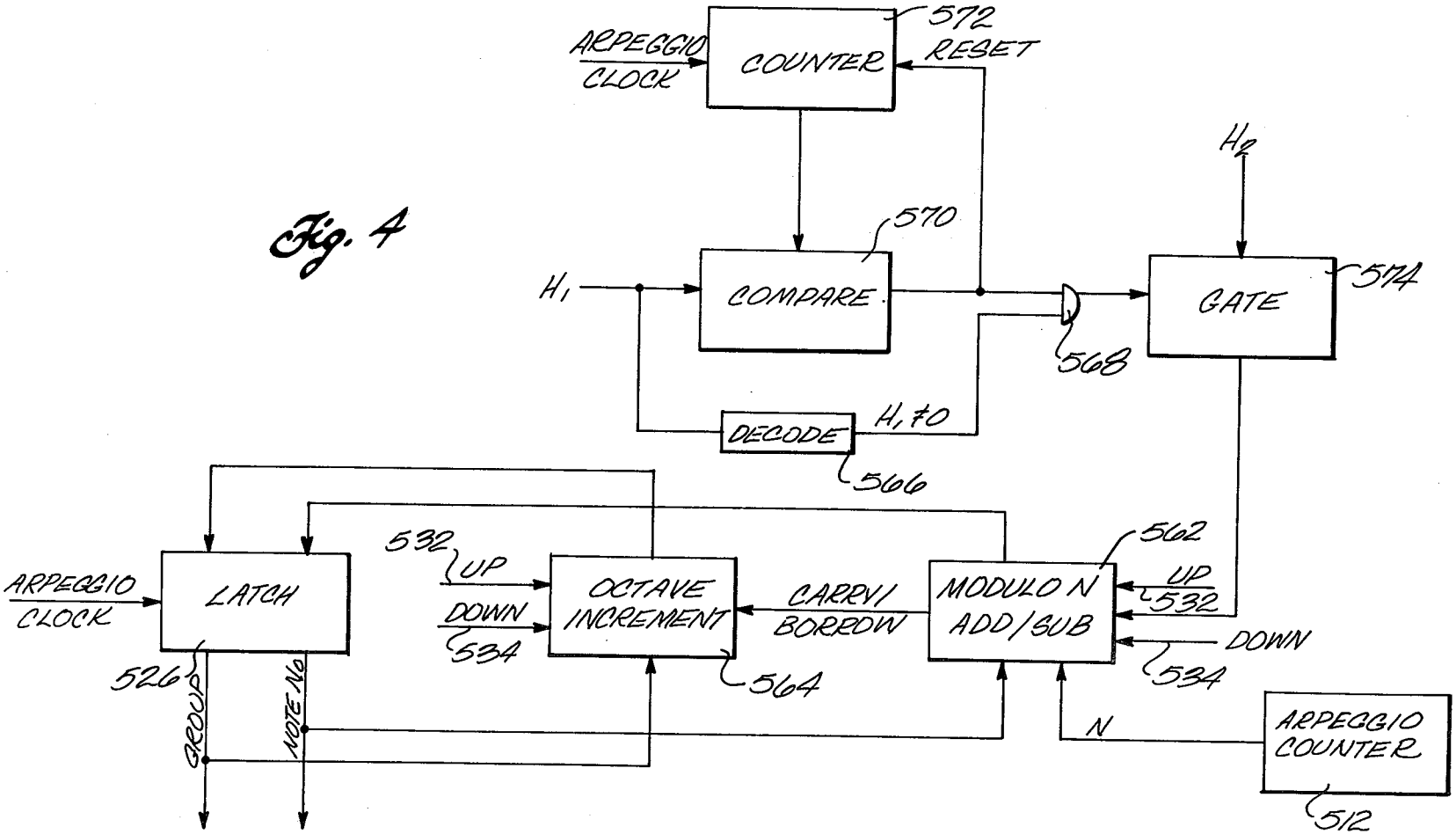
FIG. 4 is a block diagram of the arithmetic control unit.
Figure 5:
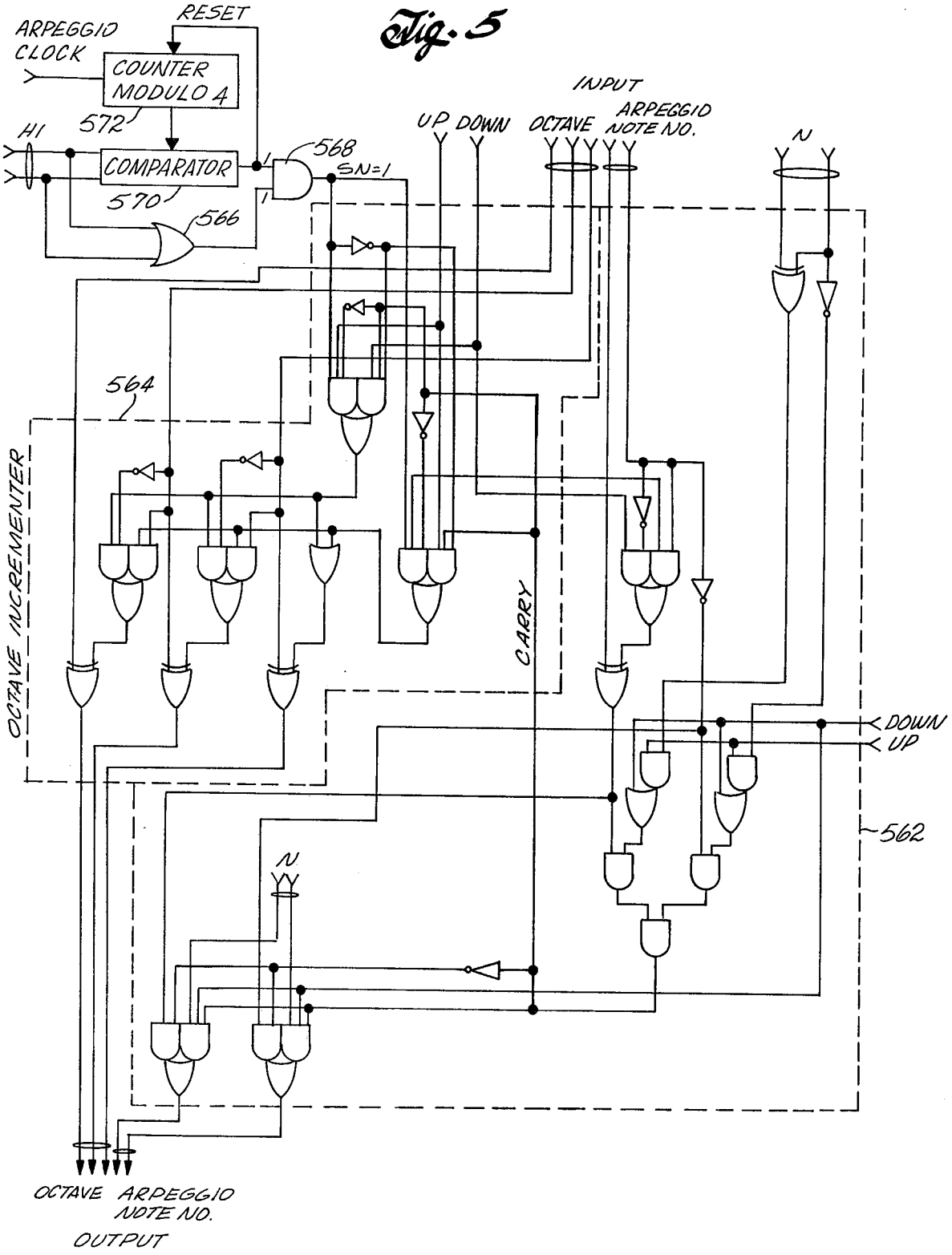
FIG. 5 is a logic diagram of one embodiment of the arithmetic unit.

The operation of the arithmetic unit 540 in controlling the note number and group number in the data latch 526 can best be understood by references to FIGS. 4 and 5. The contents of the latch 526 are updated by the arithmetic unit with each arpeggio clock so as to point to the next note in the arpeggio sequence. The arithmetic unit makes a determination of what the next note should be in response to a number of input conditions. First the arithmetic unit receives the current octave and note number information stored in the latch 526. It responds to the arpeggio UP or arpeggio DOWN signals on the input lines 532 and 534. For a normal arpeggio in which a control input $H_1=1$, the arithmetic unit for an UP arpeggio increments the note number by one and reloads the new value in the latch 526 with the next arpeggio clock. The note number is incremented by one with each subsequent arpeggio clock until the note number is equal to the value N, the number of keys actuated in generating the arpeggio chord, as indicated by the count condition of the arpeggio counter 512. The note number is then restored to the initial value and the group number is incremented by one. For a DOWN arpeggio this process is reversed, the note number being set to N initially and being decremented with each arpeggio clock. For a control input $H_1$ equal to a value other than one, the incrementing of the octave and note number is interrupted after a number of arpeggio clocks corresponding to the value of $H_1$ and the value of $H_2$ is subtracted (or added for a DOWN arpeggio) from the note number. The effect is that for an UP arpeggio, the note number is incremented $H_1$ times to produce a sequence of arpeggio chord notes in sequence. When $H_1$ number of notes are generated, $H_2$ is subtracted so that the next note in sequence is lower in the chord by a number of notes determined by the value of $H_2$. The UP arpeggio then resumes for a number of notes determined by $H_1$. Thus the arpeggio advances $H_1$ notes, drops back $H_2$ notes, and then advances $H_1$ notes again to produce a harp-like arpeggio effect. If $H_2$ is 1, the same note is played twice after a number of notes determined by $H_1$ has been played. Normally $H_1$ would be selected to be greater than $H_2$ but need not be. If $H_2$ is one less than $H_1$, the arpeggio notes will all be repeated and the arpeggio chord will not advance up or down the scale.

Referring again to FIG. 4, incrementing or decrementing of the note number in the latch 526 is provided by a modulo N add/subtract circuit 562. The modulo N add/subtract circuit 562 adds one to the value of the note number for an UP arpeggio or subtracts one from the note number for the arpeggio DOWN. The new value is loaded in the latch 526 with the next arpeggio clock. This continues for each successive clock until the note number reaches the value N as derived from the arpeggio counter 512. The modulo N add/subtract 562 then returns the output to the initial note number value and produces a carry which is applied to an octave increment circuit 564 which increments (or decrements) the octave value group number and stores it in the latch 526 with the next arpeggio clock. The group number is incremented if an UP arpeggio is indicated and is decremented if a DOWN arpeggio is indicated. When $H_1$ is other than one, as sensed by a decoder circuit 566, it activates one input of an AND circuit 568. The value of $H_1$ is also applied to one input of a compare circuit 570 which compares the value $H_1$ with the count condition of a counter 572 which counts successive arpeggio clocks. When the number of clocks corresponds to the value $H_1$, the output from the compare circuit resets the counter 572 and activates a gate 574 through the AND circuit 568. The gate 574 gates the value $H_2$ to the modulo N add/subtract circuit 562 where it is subtracted for an UP arpeggio or added for a DOWN arpeggio to the current note number. Thus note numbers in the latch 526 for an UP arpeggio are incremented a number of times determined by the value of $H_1$. If the note number reaches N, the group number is incremented. With the next arpeggio clock, the value of $H_2$ is subtracted from the note number. If this subtraction results in a borrow, the octave increment circuit 564 decrements the group number in the latch by one.

Referring to FIG. 5, there is shown one example of a complete logic diagram for the arithemetic unit in which $H_2$ is made equal to N. Because the circuit uses binary logic, the value of N, $H_1$, the note number, and the group number are binary coded bits. Thus N=1 is coded 00, N=2 is coded 01, N=3 is coded 10, and N=4 is coded 11. The same is true for $H_1=1\rightarrow4$, note number$-1\rightarrow4$. Three binary bits are used for coding the group numbers $1\rightarrow6$.

What is claimed is:

1. In a keyboard operated electronic musical instrument having a plurality of tone generators and memory means for storing a plurality of tone generator control words, means responsive to actuation of the keys on the keyboard for coding a corresponding number of the control words to indicate the note and the associated octave of each actuated key, and means assigning the coded control words to a corresponding number of the tone generators to activate and set the pitch of the tone generators, automatic arpeggio apparatus comprising: means responsive to the activation of a group of keys forming an arpeggio chord for coding a corresponding number of control words in the memory means to indicate each of the notes of the chord, means counting the number of keys forming the chord, means storing the count number of each note in the chord, and means including an arpeggio clock for transferring each of the arpeggio chord note control words in synchronism with the arpeggio clock from the memory means to one of the tone generators sequentially according to said stored count numbers.

2. Apparatus of claim 1 further including means generating an octave number, means transferring the octave number with each control word transferred to said one of the tone generators.

3. Apparatus of claim 2 further including means for changing the octave number to a new octave number after the last of the control words of the arpeggio chord have been transferred from the memory means to said one of the tone generators, and means repeating the transfer of the arpeggio chord note control words in sequence to said one of the tone generators from the memory together with the new octave number in synchronism with the arpeggio clock.

4. Apparatus of claim 3 further including tone envelope generating means for modulating the amplitude of the output of said one of the tone generators to provide an attack/decay characteristic, and means for triggering the tone envelope generating means with each clock of the arpeggio clock.

5. In a keyboard operated tone synthesizer having a tone generator where pitch is controlled by coded input information identifying the note and octave of the tone to be generated, automatic arpeggio apparatus comprising means responsive to a keyed group of notes forming an arpeggio chord for storing coded information identifying each of the keyed notes in the chord, means including a source of arpeggio clock pulses for transferring the stored information for each of the notes in predetermined sequence to the tone generator with each successive arpeggio clock, means generating a coded octave number, means transferring the coded octave number to the tone generator with each arpeggio clock, and means for changing the octave number after a predetermined number of arpeggio clock pulses.

6. Apparatus of claim 5 wherein said means for transferring the stored information for each of the notes includes means for selectively transferring the notes in a sequence of rising pitch.

7. Apparatus of claim 5 wherein said means for transferring the stored information for each of the notes includes means for selectively transferring the notes in a sequence of lowering pitch.

8. Apparatus of claim 6 further including means indicating the number of notes in the chord, and means changing the octave number from said means generating the coded octave number whenever the number of arpeggio clock pulses transferring note information to the tone generator is an integral multiple of the number of notes in the arpeggio chord.

9. Apparatus of claim 5 further including tone envelope generating means for modulating the amplitude of the output of the tone generator to provide an attack-/decay characteristic, and means for triggering the tone envelope generating means with each pulse of the arpeggio clock.

10. Apparatus of claim 5 further including means for storing a sequence number for each keyed note of the arpeggio chord indicating the relative position of the note in the chord.

11. Apparatus of claim 10 further including means indicating the number of notes in the chord, said means for changing the octave number including means sensing when the number of notes transferred to the tone generator by successive arpeggio clocks is equal to the number of notes in the chord.

12. Apparatus of claim 11 further including means responsive to the stored sequence number and to coded input signals for selecting any one of the stored notes of the arpeggio chord with each arpeggio clock pulse for transfer to the tone generator.

13. An automatic arpeggio control for a keyboard instrument having a tone generator for generating a musical tone having the pitch controlled by coded note and octave input information, comprising: memory means responsive to operation of a group of keys forming an arpeggio chord on the keyboard for storing coded information identifying each of the notes in the chord, the relative position of each note in the chord, and the number of notes in the chord, an arpeggio clock for generating arpeggio clock pulses, and means generating and transferring note and octave information with each arpeggio clock pulse to the tone generator, said means including an initializing unit for generating initial octave information and selecting an initial one of said notes stored in said memory means for transfer to the tone generator, and arithmetic means for determining the next octave number and note information in the memory means to be transferred to the tone generator with the next arpeggio clock.

14. Apparatus of claim 13 wherein said arithmetic unit includes means responsive to the relative position in the arpeggio chord of the note information transferred to the tone generator for reading out the next note information from memory with each arpeggio clock pulse in predetermined sequence, means repeating the note information transferred from the memory means and incrementing the octave number transferred to the tone generator after all the stored note information has been transferred to the tone generator.

15. Apparatus of claim 14 wherein the arithmetic unit further includes means responsive to first and second coded inputs designating a predetermined number of notes for limiting the number of notes generated in said predetermined sequence by a number of successive arpeggio clock pulses determined by said first coded input, and means initiating a new sequence by repeating a number of notes determined by the second coded input during successive arpeggio clock pulses, whereby the notes of the arpeggio chord can be played in overlapping chord sequence.

* * * * *